US006808246B2

(12) United States Patent
Long

(10) Patent No.: US 6,808,246 B2
(45) Date of Patent: Oct. 26, 2004

(54) START-UP AND SHUT DOWN OF CONTINUOUS INKJET PRINT HEAD

(75) Inventor: Michael Long, Hilton, NY (US)

(73) Assignee: Eastman Kodak Company, Rochester, NY (US)

( * ) Notice: Subject to any disclaimer, the term of this patent is extended or adjusted under 35 U.S.C. 154(b) by 7 days.

(21) Appl. No.: 10/320,884

(22) Filed: Dec. 17, 2002

(65) Prior Publication Data

US 2004/0113970 A1 Jun. 17, 2004

(51) Int. Cl.[7] ..... B41J 2/165
(52) U.S. Cl. ..... 347/22; 347/35; 347/31
(58) Field of Search ..... 347/22, 25–31, 347/34–37, 73, 74, 77, 82, 83

(56) References Cited

U.S. PATENT DOCUMENTS 4,024,548 A * 5/1977 Alonso et al. ..... 347/34
4,240,082 A 12/1980 Yu
4,514,735 A * 4/1985 Jones ..... 347/76
4,628,331 A 12/1986 Ishikawa
6,079,821 A 6/2000 Chwalek et al. ..... 347/77
6,588,888 B2 7/2003 Jeanmaire et al. ..... 347/77

* cited by examiner

*Primary Examiner*—Shih-Wen Hsieh
(74) *Attorney, Agent, or Firm*—William R. Zimmerli

(57) ABSTRACT

A start-up and shutdown system for removing unwanted ink from a continuous inkjet printer comprises a porous element in flow communication with a cleaning chamber, both positioned adjacent to an ink supply chamber and nozzle plate. The porous element absorbs the unwanted ink from the surface of the nozzle plate. A negative pressure source is further provided to draw the absorbed ink from the porous element via the cleaning chamber. In one embodiment, fluid valve porous elements are provided to form a transient barrier to errant ink fluid in the form of a fluid bridge during start-up and shutdown of the printer.

31 Claims, 8 Drawing Sheets

START-UP AND SHUT DOWN OF CONTINUOUS INKJET PRINT HEAD

FIELD OF THE INVENTION

The present invention relates to inkjet printers, and more particularly to inkjet printers using a continuous ink stream type print head.

BACKGROUND OF THE INVENTION

Digitally controlled printing is typically accomplished using one of two technologies referred to as "drop-on-demand" and "continuous" inkjet printing. Both printing techniques utilize ink supplies for each color of ink, with the ink being ejected through nozzles formed in a print head.

Drop-on-demand inkjet printing typically uses a thermal or mechanical actuator to provide ink droplets for deposition on a print medium. In continuous ink jet printing technology, ink is typically supplied to an ink reservoir in a print head under pressure so as to produce a jet, or continuous stream of ink from a nozzle in liquid communication with the reservoir. Periodic excitations are imposed on the ink stream to cause the stream to break up into ink droplets.

Some continuous inkjet printers utilize air flow to control the trajectory of ink droplets ejected from a print head, wherein ink droplets can be deflected from their ejection path as they leave the print head to either a print medium or an ink capturing mechanism such as a catcher or gutter. The ink captured by the capturing mechanism can either be recycled back to the ink reservoir for reuse, or disposed of.

Difficulties are often experienced during start-up of continuous stream ink jet printers, when the print head is in an initial dry nozzle plate condition. The ink driving pressure increases from zero but is initially too low to overcome surface tension and drive the ink out of the tiny nozzles in the nozzle plate. A transition period is then reached in which the ink driving pressure overcomes the surface tension effects to force some ink through the nozzles, but the pressure is still insufficient to produce well formed fluid jets of ink. During this transition period from the initial dry nozzle plate condition to fluid jets of ink, ink typically leaks from the print head nozzle and creates a fluid film or beads on the nozzle plate. A similar phenomenon occurs when the printer or print heads are shut down, after which the fluid film or beads can dry on the nozzle plate prior to the next start-up or printing operation of the print head.

A fluid film formed at the nozzle plate increases the probability that fluid leaving the nozzle plate will never overcome the surface tension of the film formed at the nozzles. Fluid beads on the nozzle plate can cause nozzles under the beads to produce a continuous flow of ink that adheres to the nozzle plate. In addition, beads formed adjacent to nozzles can cause misdirection in ink ejected from such nozzles, and inconsistencies in droplet size and shape. The most common solution to clogged jets is to flush the nozzle, or plurality of nozzles with a large amount of ink, however such a method wastes the ink and is not always effective. In addition, this method may not remove the fluid beads from locations adjacent the nozzles, thus misdirected and misshapen drops continue to be ejected from the print head and produce poor quality print images.

SUMMARY OF THE INVENTION

The systems and methods of the present invention have several features, no single one of which is solely responsible for its desirable attributes. Without limiting the scope of this invention as expressed by the claims which follow, its more prominent features will now be discussed briefly. After considering this discussion, and particularly after reading the section entitled "Detailed Description of the Invention" one will understand how the features of this invention provide several advantages over traditional ink jet printers.

One aspect is a method of reducing accumulation of unwanted matter on a surface of a print head of an ink jet printer system during start-up and shutdown which comprises ejecting a stream of ink from the surface of the print head nozzles and into a slit in one or more porous elements, the stream of ink comprising, an aligned portion which follows a first path from the surface of the print head nozzles and through the slit in the porous element to a print medium, and a misdirected portion which follows a second path different than the first path, wherein the second path contacts a porous element, and absorbing the misdirected portion through a surface of the porous element.

Another aspect is a system for removing unwanted particles from one or more print head nozzles, comprising means for absorbing the unwanted particles at the print head nozzle and a surrounding area.

Still another aspect is a printing system that comprises a print head configured to eject a stream of ink from a plurality of nozzles and towards a print medium and a porous element positioned proximate to an ink ejection area of the plurality of nozzles, wherein an errant portion of the stream of ink is absorbed by the porous element during start up and shut down phases of printer operation.

A further aspect is a method of making an ink jet printer comprising mounting a porous member within about 250 um of a print head surface such that at least some misdirected ink is captured by said porous member during a start up phase of printer operation.

Yet another aspect is an ink jet printing system that comprises a print head configured to output a stream of ink from a plurality of nozzles, and at least one porous member configured to form an absorption region in proximity to an ink ejection area of the plurality of nozzles, wherein the porous member absorbs a misdirected portion of the stream of ink.

DETAILED DESCRIPTION OF THE INVENTION

Embodiments of the invention will now be described with reference to the accompanying Figures, wherein like numerals refer to like elements throughout. The terminology used in the description presented herein is not intended to be interpreted in any limited or restrictive manner, simply because it is being utilized in conjunction with a detailed description of certain specific embodiments of the invention. Furthermore, embodiments of the invention may include several novel features, no single one of which is solely responsible for its desirable attributes or which is essential to practicing the inventions herein described.

Figure 1:
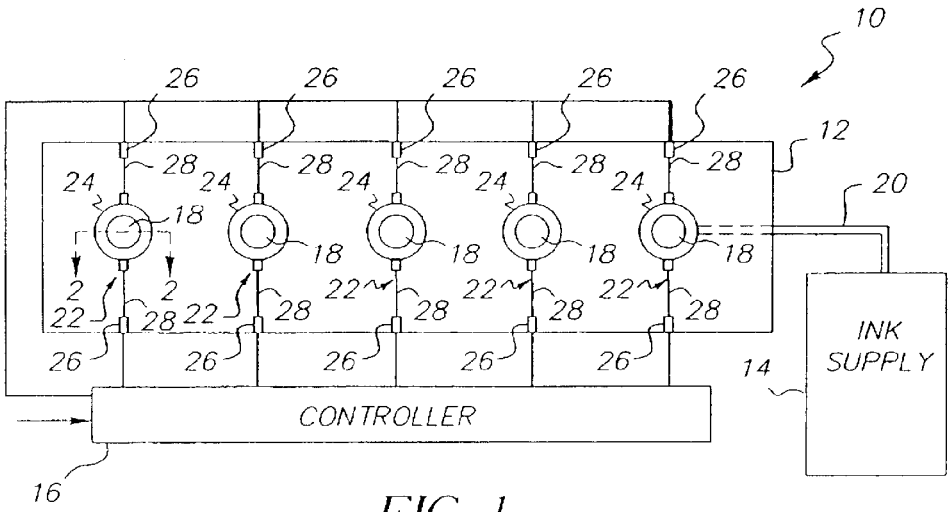
FIG. 1 is an illustration of one embodiment of a printing system.

An exemplary printing system 10 is illustrated in FIG. 1, wherein the printing system 10 can be implemented in a printer along with systems and methods described further herein.

The printing system 10 comprises a print head 12, at least one ink supply 14, and a controller 16. The print head 12 can be formed from a semiconductor material, such as silicon, using fabrication techniques well known in the field. A plurality of nozzles 18 can be formed on the print head 12, wherein the nozzles 18 are in fluid communication with the ink supply 14 through an ink passage 20, also formed in the print head 12.

In the embodiment of FIG. 1, a heater 22 is positioned or formed on the print head 12 at each nozzle 18 so as to facilitate the ejection of ink filaments from the nozzle 18 and break-up of the filaments into droplets. In the present embodiment, the heater 22 is implemented with a resistive heat element 24 coupled to electrical contact pads 26 via conductors 28. The contact pads 26 can be coupled to the controller 16 such that the controller 16 controls activation of the resistive heat element 24, thus controlling the production of the stream of ink droplets produced by the nozzles 18.

Figure 2:
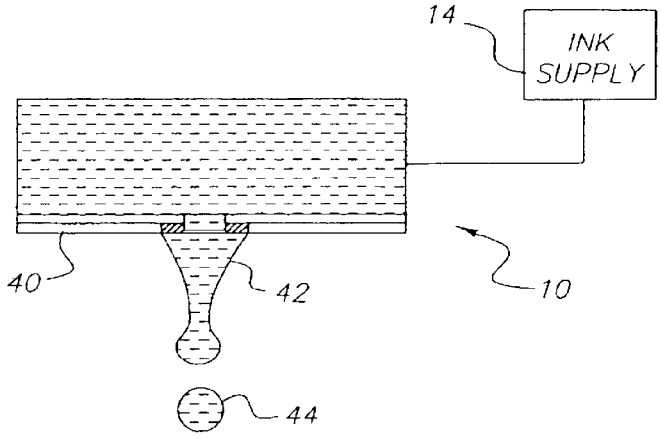
FIG. 2 is a cross-sectional view of the printing system of FIG. 1.

FIG. 2 is a cross-section of the print head 12 shown in FIG. 1, illustrating the expulsion of ink from the nozzle 18. As can be seen in FIG. 2, the print head 12 comprises a nozzle plate 40 having a plurality of nozzles, through which ink leaves the print head 12. During operation, ink from the ink supply 14 is ejected through the nozzle in the nozzle plate 40 of the print head 12 to create a filament 42 of ink. The resistive element 24 can be activated to break up the filament 42 into a stream of individual ink droplets 44 for deposition on a print medium. The area around the nozzles in the nozzle plate 40 are the primary areas where excess ink and debris form, which adversely affect the performance of the printer.

It will be appreciated that the printing system 10 as shown and described in reference to FIGS. 1 and 2 is exemplary in nature, and the invention is not limited to such a print system.

Figure 3:
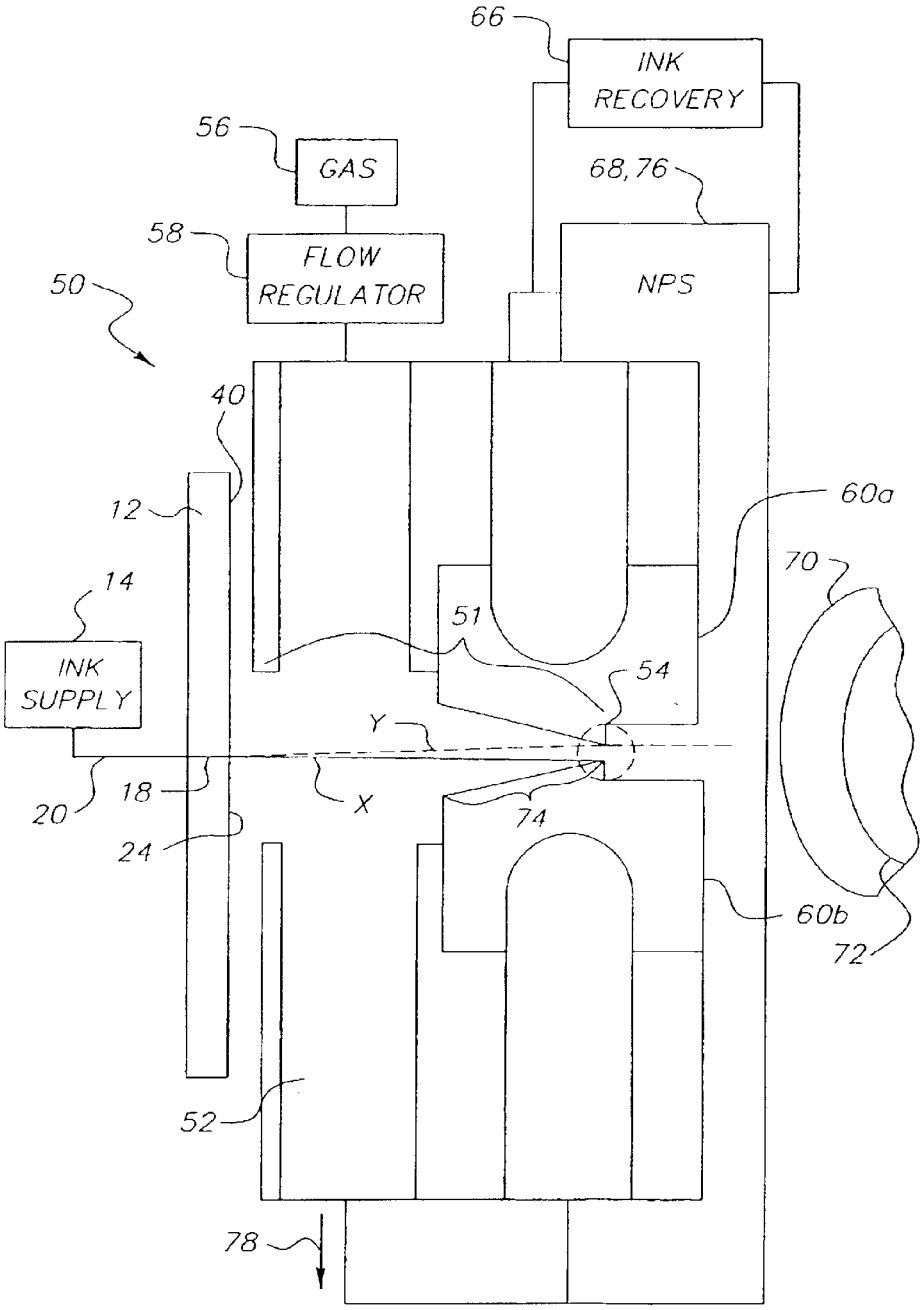
FIG. 3 (PRIOR ART)
FIG. 3 is a cross-sectional side view of one embodiment of a printer implementing the printing system of FIGS. 1–2.

The printing system 10 can be implemented, for example, in the printer 50 illustrated in FIG. 3. Various exemplary embodiments of printer systems suitable for use with the present invention are described in more detail in U.S. patent application Ser. No. 09/751,232, filed Dec. 28, 2000, and entitled "CONTINUOUS INK-JET PRINTING METHOD AND APPARATUS," hereby incorporated by reference in its entirety. The printer 50 employs a droplet deflection region 51 comprising a gas flow chamber 52 positioned near the nozzle plate 40 such that ink ejected from the nozzle 18 travels through the gas flow chamber 52 and out an opening 54 substantially aligned with the nozzle 18. Gas flow is provided by a gas source 56 and regulated by a gas flow regulator 58 prior to entry into the gas flow chamber 52. The gas flow source 56 can be, for example, an air supply or a nitrogen supply.

A stream of large volume ink droplets and small volume ink droplets, formed from the ink filament 42, can be ejected from the nozzle 18 substantially along a path X. In the droplet deflector system 51, gas flow can be provided to the gas flow chamber 52 to apply a force to the stream of ink droplets ejected from the nozzle 18. In this way, the small volume ink droplets diverge from path X along a printing path Y. The large volume ink droplets may continue along path X and into a catcher 74. The catcher 74 can be a porous element, a mesh screen, or a gutter type device. In this way, the catcher 74 catches ink ejected from the print head during start-up, shut down, or a cleaning procedure such that the ink is not allowed to reach the print medium 70. The catcher 74 routes the ink from the large volume ink droplets to, for example, an ink recovery system 66.

A negative pressure source 68 can apply a negative pressure to the catcher 74. The negative pressure source 68 assists in the separation of the small ink droplets from the large ink droplets and the recovery of the ink droplets traveling substantially along path X.

The printing path Y leads the small ink droplets to a print medium 70 supported on a print drum 72. The catcher 74 positioned at or near the opening 54, prevent ink droplets that stray from the printing path Y from contacting the print medium 70. During printing, small ink droplets are selectively generated that will follow path Y to the print medium at the desired locations. When no droplets are to be applied to the media, large droplets are generated which hit the catcher 74.

An additional negative pressure source 76 can be provided at an outlet 78 of the gas flow chamber 52 so as to apply a negative pressure at the other end of the gas flow chamber 52 and assist in the separation of the small ink droplets and the large ink droplets. Also, the negative pressure source 76 can be coupled to the catcher 74 so as to assist in the removal of ink collected by the catcher 74 during operation. The outlet 78 of the gas flow chamber 52 may also have fluid communication with the ink recovery system 66.

One problem with the system shown in FIG. 3 is that during start up and shut down of the printer system, ink from the print head may be ejected far off from path X, and collect near and on the print head itself. During this period, the catcher is generally ineffective as a means to keep ink which is not used for printing on the media from negatively affecting printer operation. A new method of dealing with this issue is presented below with reference to the following Figures.

Figure 4:
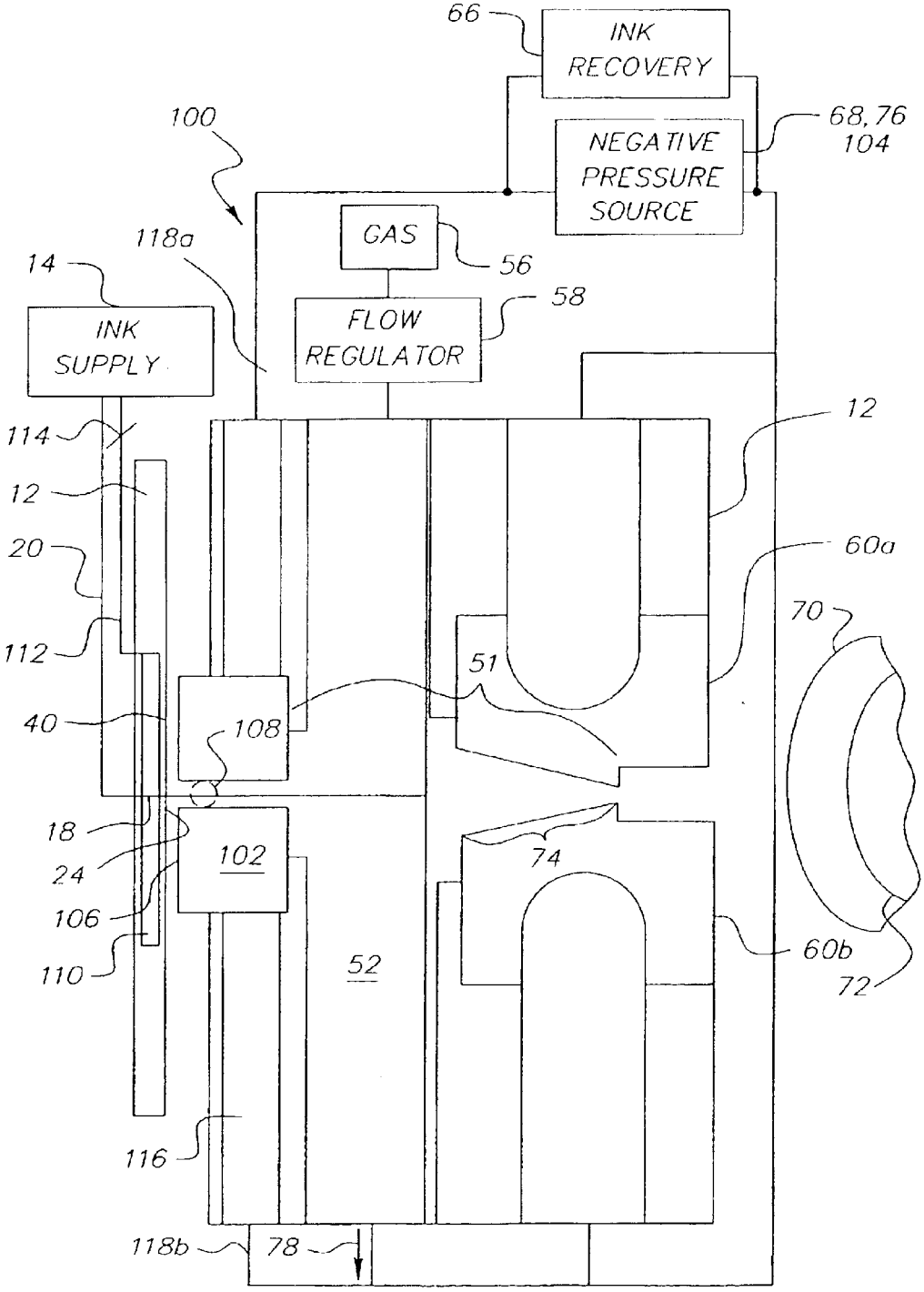
FIG. 4 is a cross-sectional side view of one embodiment of a printing system incorporating a porous element.

FIG. 4 illustrates a cross-sectional view of one embodiment of a start-up and shut down system 100, which can be implemented in the printer 50 in combination with the droplet deflector system 51. This embodiment comprises at least one porous element 102 and a negative pressure source 104. Alternatively, the porous element 102 comprises two porous elements having a separation therebetween.

The porous element 102 has a surface 106 which may be approximately parallel and in close proximity to the nozzle plate 40 of the print head 12. The planar surface 106 may be in abutting contact with the nozzle plate 40. In one embodiment the porous element 102 comprises 85% $Al_2O_3$ with a 40% average porosity and an average pore diameter of 20 $\mu$m. The nominal filtration level of the porous element 102 in water can be 5 $\mu$m. The described embodiment of the porous element 102 functions as a filter. Over time, the porous element 102 may be cleaned or replaced to maintain peak ink absorption.

Capture of misdirected ink droplets and their removal from the porous element 102 can reduce the formation of a fluid film or fluid beads immediately adjacent to the nozzle plate 40. In this way, ink droplets which do not pass completely through the slit 108, do not adhere to the nozzle plate 40.

A slit 108 formed in or by the porous element(s) 102 defines a passageway for the ink droplets 44 to pass when they are ejected from the print head 12. Different embodiments of the slit 108 can have different widths. For example, in one embodiment the width of the slit 108 is about 125 $\mu$m. In another embodiment, the width of the slit 108 is about 250 $\mu$m. As will be described with reference to FIG. 7, the width of the slit 108 can vary with distance from the nozzles along the thickness of the porous element 102.

In addition, a negative pressure source 104 may be coupled with the porous element 102. In the embodiment shown in FIG. 4, the negative pressure source 104 is analogous to the negative pressure sources 68, 76 previously described with reference to FIG. 3.

Returning again to FIG. 4, the ink supply 14 provides ink to an ink supply chamber 110. The ink supply chamber 110 can have an outlet 112 with a valve 114 so as to control the fluid pressure in the ink supply chamber 110. In communication with the ink supply chamber 110 is the nozzle plate 40 with a plurality of openings forming a respective plurality of ink ejection nozzles 18. The nozzle plate 40 is preferably formed from a material which exhibits a hydrophobic response to the selected ink. For example, a silicon plate could be used.

In one embodiment, a cleaning chamber 116 is located parallel to the ink supply chamber 110 and is in flow contact with the porous element 102 and the negative pressure source 104. The cleaning chamber 116 functions as a manifold for collecting the ink absorbed by the porous element 102. Ink droplets ejected from the nozzles 18 travel through the slit 108 in a perpendicular direction to the cleaning chamber 116. The slit 108 is substantially aligned with the nozzles 18. The ink droplets 44, which contact the porous element 102 as they pass through the slit 108 are absorbed by the porous element 102 and collect in the cleaning chamber 116.

As shown in FIG. 4, the ink droplets 44 that are absorbed by the porous element 102 are drawn into the cleaning chamber 116 in a flow direction substantially perpendicular to a direction in which ink is ejected from the nozzles 18. As the absorbed ink droplets 44 are removed from the cleaning chamber 116 by the negative pressure source 104, debris and excessive ink are cleared from the opening and surrounding area of the nozzles 18. The debris and excessive ink cleared by the cleaning chamber 116 flows out of the cleaning chamber and through outlets 118(*a*), 118(*b*) located at the ends of the cleaning chamber.

In the embodiment illustrated in FIG. 4, the ink recovery system 66 is in flow communication with the outlets 118(*a*), 118(*b*) and is configured to recover the ink drawn from the porous element 102. Alternatively, an additional ink recovery system is used.

In another embodiment of the start-up and shut down system 100, the system is configured to perform a jet integrity sensing function. This function can be performed during steady state operation of the printer 50. For example, assuming that the nozzles 18 are operating properly, the closely spaced upper and lower surfaces of the porous element 102 are normally dry while printing when not starting or stopping the printer 50. However, the fluid from a partially occluded nozzle 18 that drips will be captured by the porous element 102. Once captured, a fluid presence sensor (not shown) may be provided to detect the fluid. Corrective action can then to taken to perform a cleaning procedure or maintenance operation to the printer 50. Thus, the presence of ink droplets 44 in the start-up and shut down system 100 during normal operation can indicate that one or more of the nozzles is leaking fluid.

As described and shown herein, the gas flow chamber 52 of the drop deflector system 51 is positioned adjacent to the cleaning chamber 116, however the invention is not limited to such a structure. In one embodiment, the gas flow chamber 52 is more particularly a substantially contained gas flow path positioned approximately parallel to the cleaning chamber 116, such that a stream of ink leaving the cleaning chamber 116 passes through a gas flow path of the drop deflector system 51. In addition, the droplet deflector system 51 can be implemented in a number of configurations in combination with the cleaning chamber 116 so as to effectively direct the appropriate ink droplets to the print media 70 in a desirable manner.

Figure 5:
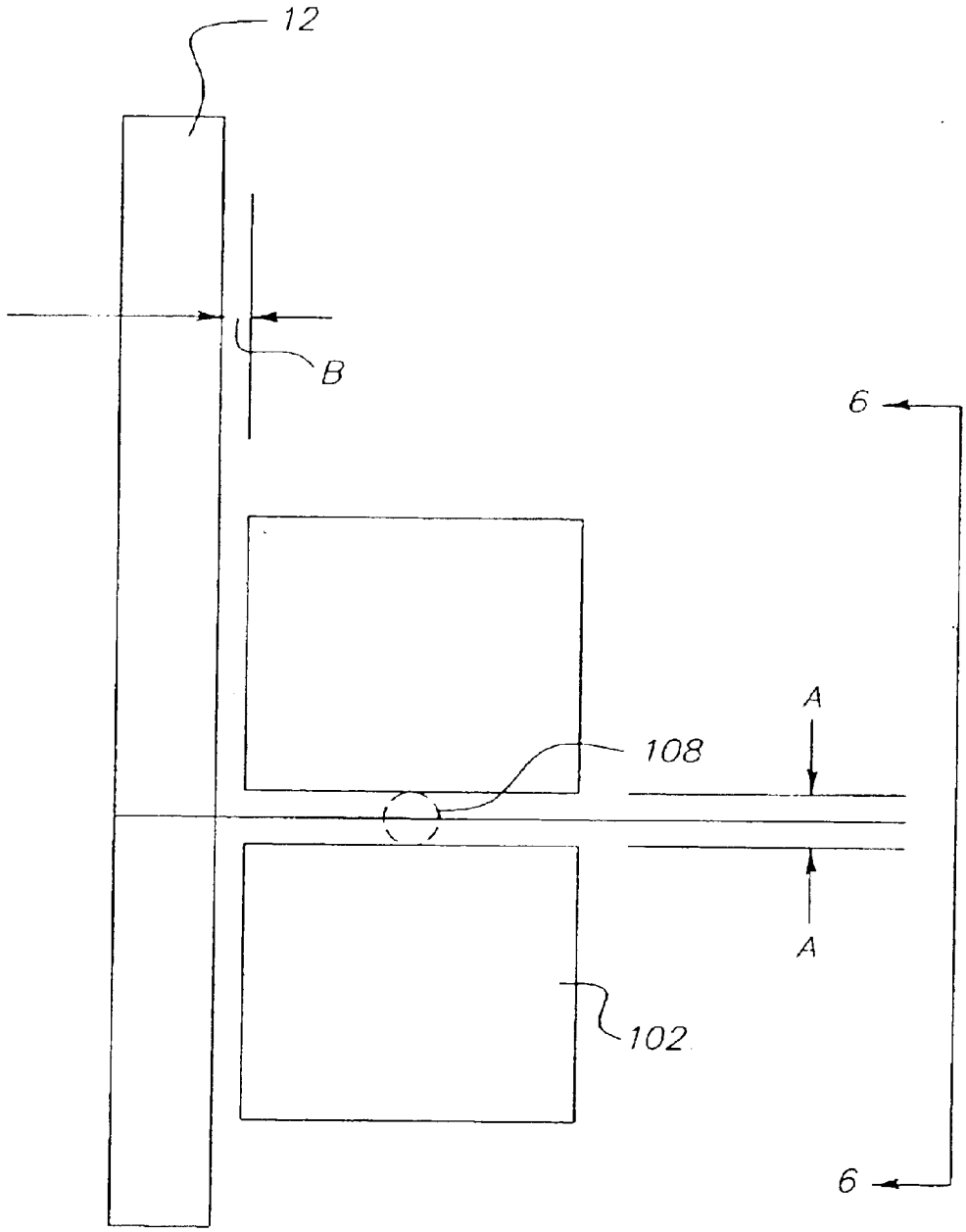
FIG. 5 is a side elevation view of the print head spaced away a distance B from the porous element.

FIG. 5 is a side elevation view of the print head 12 spaced away a distance B from the porous element 102. In one embodiment, the distance B is 250 $\mu$m. The slit 108 in the porous element 102 is illustrated as having a width A. In different advantageous embodiments, the width A may be anywhere from about 125 to about 250 $\mu$m.

Figure 6:
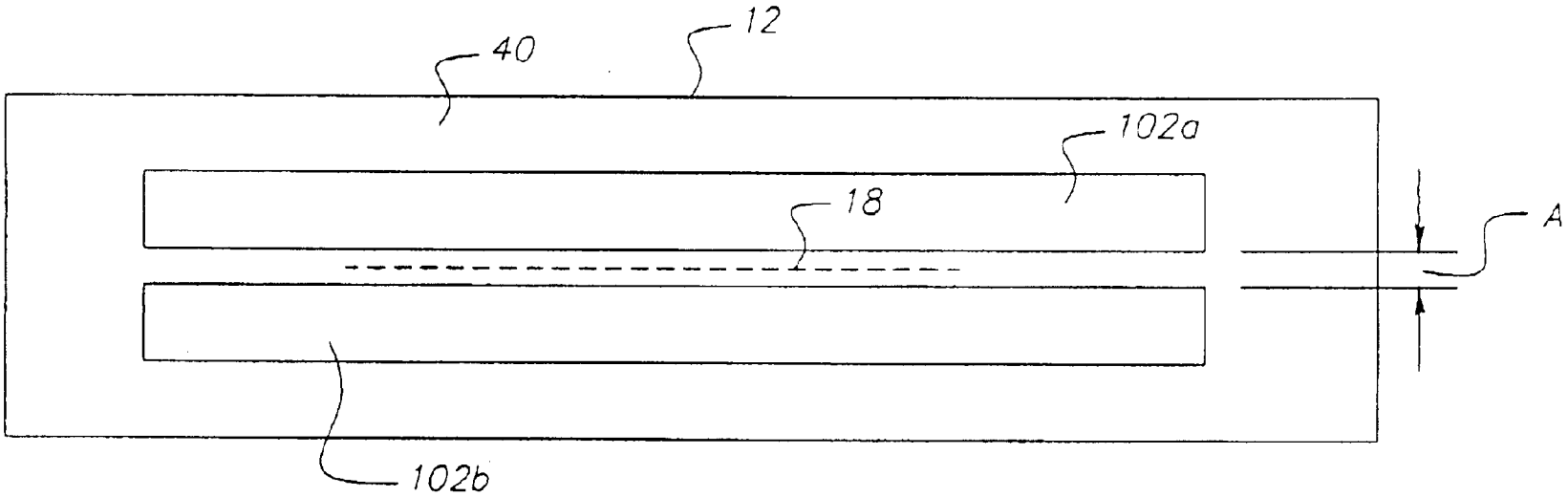
FIG. 6 is a front elevation view of the nozzle plate with the porous element comprising two adjacent porous elements.

FIG. 6 is a front elevation view of the nozzle plate 40 with the porous element 102 comprising two adjacent porous elements 102(*a*) and 102(*b*). The two porous elements 102(*a*), 102(*b*) are separated by the width A. As shown in FIG. 6, the nozzles 18 are substantially aligned with the separation defined by width A. In another embodiment of the porous element 102, the porous element comprises an array of orifices substantially aligned with the nozzles 18. In this embodiment, ink droplets 44 which are misdirected in any plane will be captured by the porous element 102.

Figure 7:
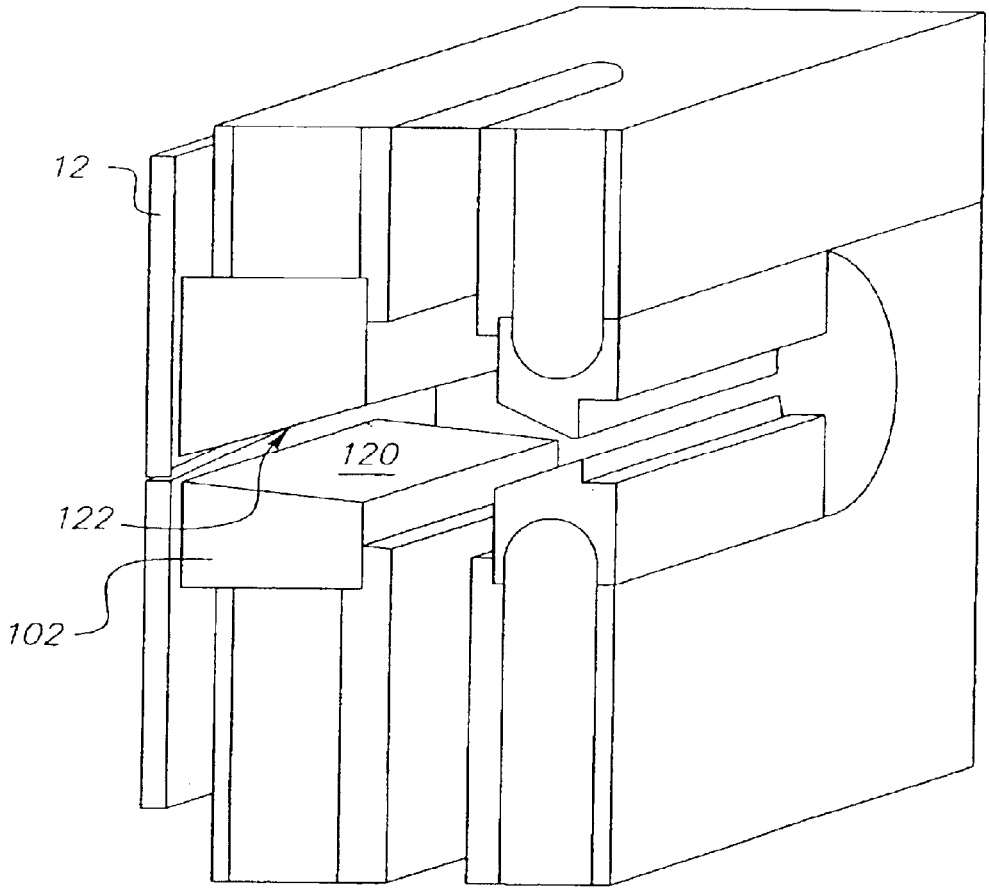
FIG. 7 is an illustration of a cross-sectional isometric view of another embodiment of a printer that incorporates a porous element with inclined surfaces.

FIG. 7 is an illustration of a cross-sectional isometric view of another embodiment of the start-up and shut down system 100. The porous element 102 shown in FIG. 7 includes faces 120 and 122. The faces 120, 122 are inclined at an angle relative to the direction of ink droplet ejection from the print head 12. By inclining the faces 120, 122 errant ink droplets 44 are drawn along the faces 120, 122 and away from the print head 12. It has been found that the inclination of the faces may enhance the absorption of the errant ink droplets 44.

Figure 8:
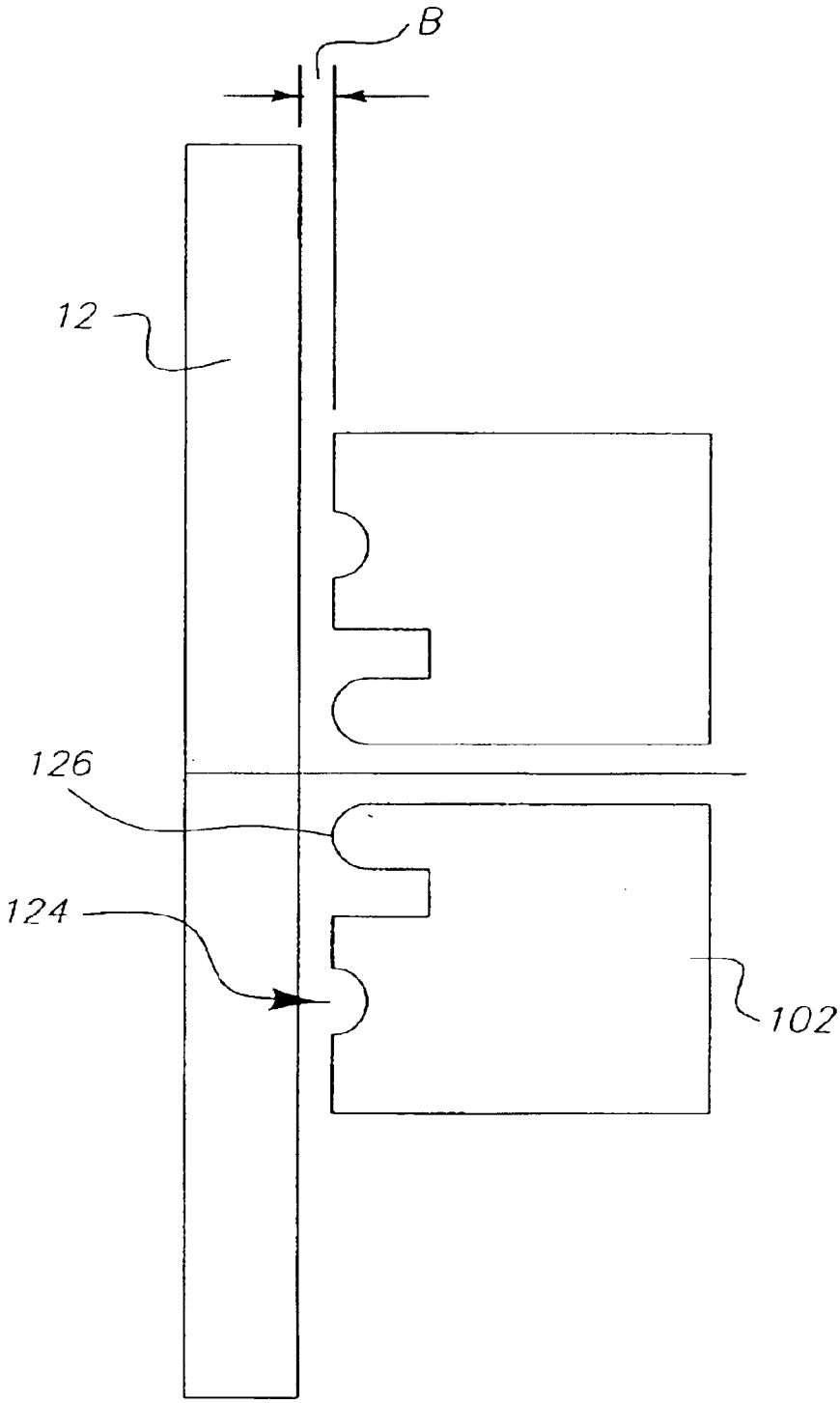
FIG. 8 is an illustration of an embodiment of a porous element that comprises concave surface features and convex surface features.

FIG. 8 is an illustration of an alternate embodiment of the porous element 102 with the inner surface being non-planar. In these embodiments, the surface may comprise concave surface features 124 and convex surface features 126. As illustrated in FIG. 8, a combination of the convex and concave surface features can be used. The planar surface 106 can comprise an asymmetrical distribution of concave and/or convex surface features.

The concave and convex surface features 124, 126 tend to act as collection sites for small fluid volumes. At least some of these sites are preferably located adjacent to the nozzles 18 so as to enhance the removal of errant ink droplets 44 from the region adjacent to the nozzles 18. As shown in FIG. 8, the concave and convex surface features are located a distance B from the print head 12. As with the planar embodiments described above, the porous element 102 may alternatively be located adjacent to the print head 12 such that the distance B is substantially zero.

Figure 9:
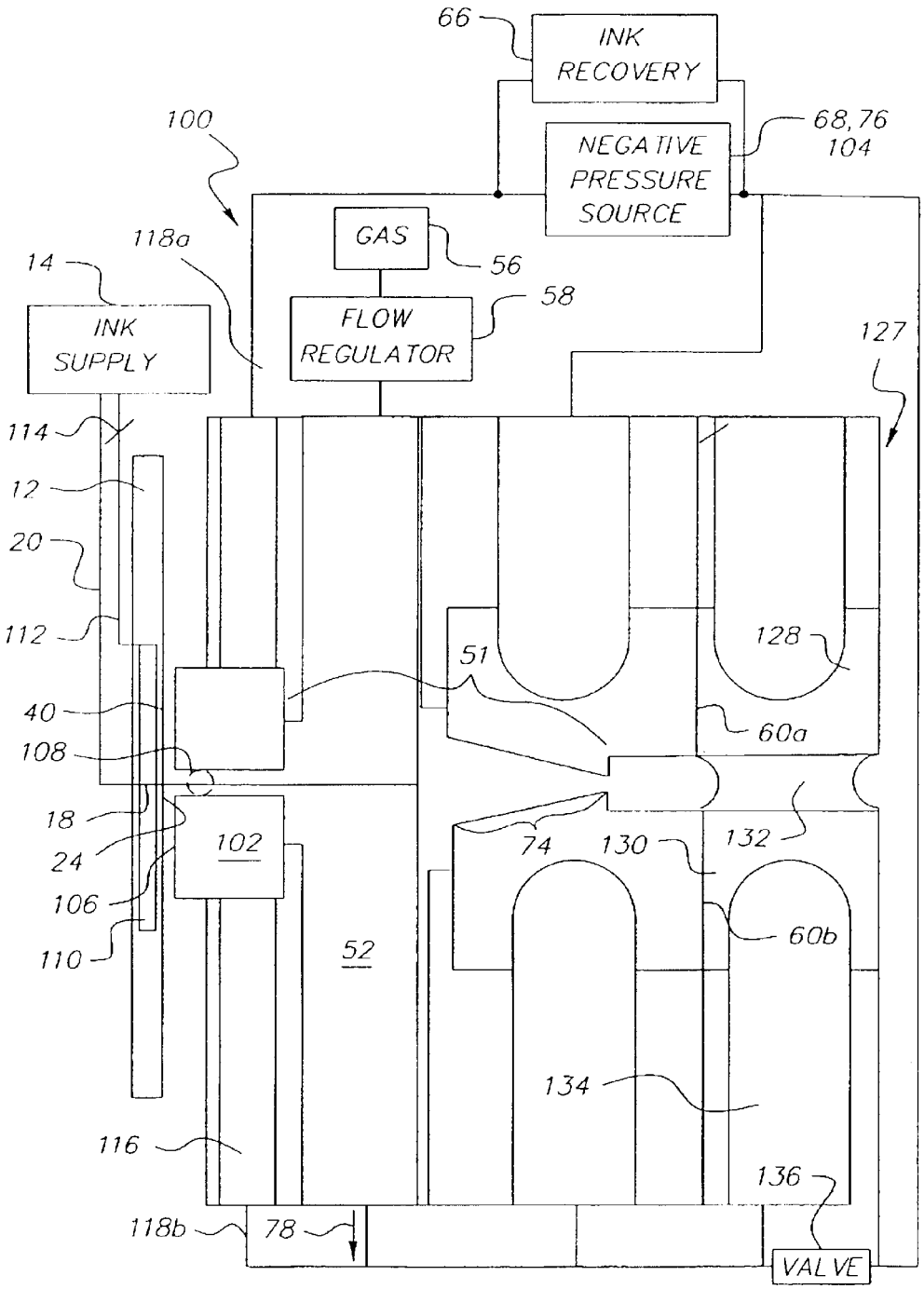
FIG. 9 is a cross-sectional view of an embodiment of the printer system from FIG. 4 further comprising a fluid valve system.

FIG. 9 is a cross-sectional view of an alternate embodiment of the printing system 50 from FIG. 4 which includes the start-up and shut down system 100 and a fluid valve system 127. The fluid valve system 127 can be used alone or in conjunction with the start-up and shut down system 100. The start-up and shut down system 100 is as described with reference to FIG. 4. The fluid valve system is configured to form a temporary (e.g. transient) barrier, or fluid bridge 132, between the ejected ink droplets 44 and the print medium 70. As will be explained, formation of the fluid bridge 132 is advantageous during start-up and/or shutdown phases of the printer 50.

The embodiment of the fluid valve system 127 shown in FIG. 9 comprises fluid valve porous elements 128, 130, a cleaning chamber 134, a valve 136, and a negative pressure source 104. The closely spaced surfaces of the fluid valve porous elements 128, 130 form a passageway for the ink droplets 44 to reach the print medium 70. The passageway can be, for example, 125 $\mu$m. The fluid valve porous elements 128, 130 are ported to the negative pressure source 104 via the cleaning chamber 134.

Depending on the operational state of the negative pressure source 104, the passageway or the fluid bridge 132 is formed between the fluid valve porous elements 128, 130. For example, when the negative pressure source 104 is not restricted, the fluid bridge 132 does not form and the ink droplets 44 pass through the fluid valve porous elements 128, 130. The fluid bridge 132 is established between the fluid valve porous elements 128, 130 when the valve 136 restricts the negative pressure source 104. When this occurs, the ink droplets 44 ejected from the nozzle plate 40 that pass through the porous element 102 and the gutter 60(*a*), 60(*b*) will not pass through the fluid bridge 132. This creates a robust fluid shutter capable of nullifying the undesirable effects of transient nozzle 18 behavior such as misting and misdirection associated with start-up and shut-down. The fluid bridge 132 can limit the errant ink fluid from leaving the print head 12 and striking the print medium 70. Moreover, the fluid bridge 132 further suppresses the momentary spray and nozzle deflection that occur when the fluid nozzles 18 first impinge the catcher 74 and/or gutter 60(*a*), 60(*b*) when the catcher and/or gutter are in a dry configuration.

Since the passageway between the fluid valve porous elements 128, 130 may be on the order of 125 $\mu$m, the volume of fluid in the fluid bridge 132 is correspondingly small and may be established and removed relatively quickly. The rapid creation and removal of the fluid bridge 132 act as a fast valve for the fluid nozzles 18. The fluid flow exiting the fluid valve porous elements 128, 130 to the cleaning chamber 134 would just equal the nozzle 18 flow rate in order to maintain the fluid bridge 132.

Embodiments of the fluid valve system 127 comprise a perforated porous fluid valve element. The perforated fluid valve element comprises an array of passageways that are aligned with the nozzles 18 to form a plurality of fluid bridges. In some embodiments, a diameter of the passageways is less than a pitch spacing of the nozzles. For example, the diameter of the array of passageways can be 50 um with a nozzle 18 pitch spacing of 80 um. The nozzles 18 can have a 10 um diameter.

The fluid bridge 132 can be incorporated into a printing system 10 that utilizes water and/or various inks ranging in viscosity from 1.0 to 4.5 cP and with drop velocities below about 10 meters per second. At higher drop velocities, the fluid bridge 132 is less effective with the lower viscosity inks.

Although a start-up and shut down system 100 and method is shown and described as implemented in a printer using air flow to direct a continuous stream of ink droplets, the systems and method described herein are not limited to such a printing system. The systems and methods described herein may be implemented in printing systems wherein, for example, electrostatic charge is used to direct ink droplets, or alternate configurations of air flow deflection of ink droplets are used. In such environments, the systems and methods of the described invention may be modified so as to effectively perform their intended functions.

The foregoing description details certain embodiments of the invention. It will be appreciated, however, that no matter how detailed the foregoing appears in text, the invention can be practiced in many ways. As is also stated above, it should be noted that the use of particular terminology when describing certain features or aspects of the invention should not be taken to imply that the terminology is being re-defined herein to be restricted to including any specific characteristics of the features or aspects of the invention with which that terminology is associated. The scope of the invention should therefore be construed in accordance with the appended claims and any equivalents thereof.

The invention has been described in detail with particular reference to certain preferred embodiments thereof, but it will be understood that variations and modifications can be effected within the spirit and scope of the invention.

What is claimed is:

1. An ink jet printing system, comprising:

a print head configured to output a stream of ink from a plurality of nozzles; and at least one porous member configured to form an absorption region in proximity to an ink ejection area of the plurality of nozzles, wherein the at least one porous member absorbs a misdirected portion of the stream of ink and the at least one porous member comprises a first porous member and a second porous member, the first and second porous members being separated by a space to form a slit substantially aligned with the plurality of nozzles.

2. The ink jet print system of claim 1, further comprising a negative gas pressure source in flow communication with the porous member and configured to draw the misdirected portion of the stream of ink from the porous member.

3. The ink jet print system of claim 2, wherein the misdirected portion of the stream of ink is drawn at a flow rate sufficient to remove debris and excess ink from the ink ejection area.

4. The ink jet print system of claim 2, further comprising a cleaning chamber located between the porous member and the negative pressure source to form a collection manifold for the misdirected portion of the stream of ink.

5. The ink jet print system of claim 2, wherein the at least one porous member forms a slit substantially aligned with the plurality of nozzles.

6. The ink jet print system of claim 5, wherein a width of the slit varies in width in a direction away from the plurality of nozzles.

7. The ink jet print system of claim 5, wherein the slit has a width of 125 um.

8. The ink jet print system of claim 5, wherein the slit has a width of 250 um.

9. The ink jet print system of claim 1, further comprising an ink recovery system configured to recover the misdirected portion of the stream of ink.

10. The ink jet print system of claim 1, wherein the at least one porous member comprises a surface adjacent to the plurality of nozzles.

11. The ink jet print system of claim 10, wherein the surface contacts the ink ejection area.

12. The ink jet print system of claim 10, wherein the surface comprises a convex surface feature.

13. The ink jet print system of claim 10, wherein the surface comprises a concave surface feature.

14. The ink jet print system of claim 13, wherein the surface additionally comprises a convex surface feature.

15. The ink jet print system of claim 10, wherein a distance between the surface and the ink ejection area ranges between 0 and 250 um.

16. The ink jet print system of claim 1, wherein the porous member comprises a ceramic material.

17. The ink jet print system of claim 1, wherein the at least one porous member comprises about 85% $Al_2O_3$.

18. The ink jet print system of claim 1, wherein the at least one porous member has approximately a 40% average porosity.

19. The ink jet print system of claim 1, wherein the at least one porous member has an average pore diameter of 20 um.

20. An ink jet printing system, comprising:

a print head configured to output a stream of ink from a plurality of nozzles; and at least one porous member configured to form an absorption region in proximity to an ink ejection area of the plurality of nozzles, wherein the at least one porous member absorbs a misdirected portion of the stream of ink and the at least one porous member comprises an array of passageways therethrough which are substantially aligned with the plurality of nozzles and configured to allow an aligned portion of the stream of ink to pass through the at least one porous member.

21. An ink jet printing system, comprising:

a print head configured to output a stream of ink from a plurality of nozzles;

at least one porous member configured to form an absolution region in proximity to an ink election area of the plurality of nozzles;

a negative gas pressure source in flow communication with the porous member and configured to draw the misdirected portion of the stream of ink from the porous member;

a first fluid valve porous element and a second fluid valve porous element, both in flow communication with the negative pressure source and configured to form a transient fluid bridge in a flow path of the align portion of the stream of ink; and a valve coupled to the negative pressure source and configured to vary a pressure in the first and second fluid valve porous elements to control forming the transient fluid bridge, wherein the at least one porous member forms a slit substantially aligned with the plurality of nozzles.

22. The print head system of claim 21, wherein the transient fluid bridge has a width of 125 um.

23. An ink jet printing system, comprising:

a print head con figured to output a stream of ink from a plurality of nozzles; and at least one porous member configured to form an absorption region in proximity to an ink ejection area of the plurality of nozzles;

a negative gas pressure source in flow communication with the porous member and configured to draw the misdirected portion of the stream of ink from the porous member;

at least one fluid valve porous element in flow communication with the negative pressure source and comprising an array of passageways therethrough which are substantially aligned with the plurality of nozzles to form transient fluid bridges in a flow path of an aligned portion of the stream of ink; and a valve coupled to the negative pressure source and configured to vary a pressure in the at least one fluid valve porous element to control formation of the transient fluid bridges.

24. The ink jet print system of claim 23, wherein a diameter of the array of passageways is less than a pitch spacing of the plurality of nozzles.

25. The ink jet print system of claim 24, wherein the pitch spacing is 80 um.

26. The ink jet print system of claim 24, wherein the diameter of the array of passageways is 50 um.

27. The ink jet print system of claim 23, wherein the plurality of nozzles have a 10 um diameter.

28. A method of reducing accumulation of unwanted matter on a surface of a print head of an ink jet printer system during start-up and shutdown, the method comprising:

ejecting a stream of ink from the surface of the print head nozzles and into a slit in one or more porous elements, the stream of ink comprising, an aligned portion which follows a first path from the surface of the print head nozzles and through the slit in the porous element to a print medium, and a misdirected portion which follows a second path different than the first path, wherein the second path contacts a porous element;

absorbing the misdirected portion through a surface of the porous element;

blocking the first path at a location downstream of the porous element with a fluid bridge, wherein the fluid bridge is formed through a fluid valve porous element, the fluid valve porous element being ported to a negative pressure source;

decreasing a pressure in the fluid valve porous element; and absorbing the fluid bridge into the fluid valve porous element in response to the decreasing pressure.

29. A system for removing unwanted particles from one or more print head nozzles, comprising means for absorbing the unwanted particles at the print head nozzle and a surrounding area, wherein said means for absorbing the unwanted particles comprises a first porous member and a second porous member, the first and second porous members being separated by a space to form a slit substantially aligned with the plurality of nozzles.

30. A printing system, comprising:

a print head configured to eject a stream of ink from a plurality of nozzles and towards a print medium; and a porous element positioned proximate to an ink ejection area of the plurality of nozzles, wherein an errant portion of the stream of ink is absorbed by the porous element during start up and shut down phases of printer operation and the porous element comprises a first porous member and a second porous member, the first and second porous members being separated by a space to form a slit substantially aligned with the plurality of nozzles.

31. A method of making an ink jet printer comprising mounting a porous member within about 250 um of a print head surface such that at least some misdirected ink is captured by said porous member during a start up phase of printer operation.

* * * * *

UNITED STATES PATENT AND TRADEMARK OFFICE

CERTIFICATE OF CORRECTION

PATENT NO. : 6,808,246 B2
DATED : October 26, 2004
INVENTOR(S) : Long

It is certified that error appears in the above-identified patent and that said Letters Patent is hereby corrected as shown below:

Column 9,
Line 32, delete “absolution” and insert -- absorption --.
Line 33, delete “election” and insert -- ejection --.

Signed and Sealed this

Twenty-second Day of November, 2005

JON W. DUDAS
*Director of the United States Patent and Trademark Office*